US008102228B2

(12) United States Patent
Okamoto

(10) Patent No.: US 8,102,228 B2
(45) Date of Patent: Jan. 24, 2012

(54) CORE SECURING MEMBER AND ITS STRUCTURE

(75) Inventor: Tadayuki Okamoto, Saitama (JP)

(73) Assignee: Tamura Corporation, Tokyo (JP)

( * ) Notice: Subject to any disclaimer, the term of this patent is extended or adjusted under 35 U.S.C. 154(b) by 118 days.

(21) Appl. No.: 12/225,110

(22) PCT Filed: Mar. 7, 2007

(86) PCT No.: PCT/JP2007/000177

§ 371 (c)(1),
(2), (4) Date: Sep. 15, 2008

(87) PCT Pub. No.: WO2007/108201

PCT Pub. Date: Sep. 27, 2007

(65) Prior Publication Data

US 2009/0108971 A1 Apr. 30, 2009

(30) Foreign Application Priority Data

Mar. 17, 2006 (JP) ..... 2006-073944

(51) Int. Cl.
*H01F 27/06* (2006.01)
*H01F 27/30* (2006.01)
*H01F 27/26* (2006.01)

(52) U.S. Cl. ..... 336/65; 336/67; 336/68; 336/209; 336/210

(58) Field of Classification Search ..... 336/65, 336/67–68, 209–210
See application file for complete search history.

(56) References Cited

U.S. PATENT DOCUMENTS

| | | | | |
|---|---|---|---|---|
| 3,110,873 | A * | 11/1963 | Mittermaier | 336/210 |
| 4,990,880 | A * | 2/1991 | Albert | 336/65 |
| 5,489,884 | A * | 2/1996 | Heringer et al. | 336/210 |
| 6,690,254 | B2 * | 2/2004 | McGrane et al. | 336/90 |

FOREIGN PATENT DOCUMENTS

| | | | |
|---|---|---|---|
| JP | 5-87919 | | 11/1993 |
| JP | 8-83708 | | 3/1996 |
| JP | 2001-76941 | | 3/2001 |
| JP | 2004241475 | A * | 8/2004 |
| JP | 2004-296818 | | 10/2004 |
| JP | 2005-72198 | | 3/2005 |

* cited by examiner

*Primary Examiner* — Elvin G Enad
*Assistant Examiner* — Tsz Chan
(74) *Attorney, Agent, or Firm* — McGinn IP Law Group, PLLC

(57) ABSTRACT

[PROBLEM] By simplifying a core securing structure of a reactor, miniaturization, lightweight, and low costs of the reactor are achieved.
[SOLVING MEANS] The core securing member to secure a core 109 in a case 101 in the reactor wherein the core 109 and the coil 105 are housed in the case 101 is made up of a first spring portion S1 which gives momentum to a side face of the core 109 in a horizontal direction and a second spring portion S2 which gives momentum to an upper face of the core 109 in a vertical direction. Moreover, a stopper portion to restrict popping of the core from the case and the second spring portion are integrally formed with a notch being interposed between the stopper and the second spring portion so that the stopper portion covers part of an upper face of the core.

20 Claims, 5 Drawing Sheets

Related Art

[Fig. 1]

CORE SECURING MEMBER AND ITS STRUCTURE

TECHNICAL FIELD

The present invention relates to a securing member configured to secure electronic components in a case and its structure and more particularly to the securing member configured to secure a core of a reactor in a case by using a spring member and its structure.

BACKGROUND TECHNOLOGY

In general, in a reactor, inductance is obtained by having a winding and a core made of a magnetic substance wherein the winding is wounded around the core to constitute a coil. Conventionally, the reactor is used in a voltage boosting circuit, inverter circuit, active filter circuit, or a like. In many cases, such the reactor as above is so configured as to house a core and a coil wounded around the core, together with other insulating members, into a case made of metal or a like (for example, see Patent Reference 1).

FIG. 1 is a diagram showing a core securing structure of the conventional reactor and FIG. 1(*a*) is its plan view and FIG. 1(*b*) is its side view. As shown in FIG. 1 (*a*) and FIG. 1(*b*), the core securing member in the conventional reactor is mainly made up of a vertical direction securing metal bracket 11 and a horizontal direction securing spring 12.

The base terminal portion of the vertical direction securing metal bracket 11 is secured on an upper portion of the reactor case 15 by a metal bracket securing bolt 13 and its end terminal constitutes a free terminal. To a lower face of the vertical direction securing metal bracket 11 is attached a vertical direction securing rubber bush 14. The vertical direction securing rubber bush 14 secures a core 16 to the reactor case 15 with an upper end portion of the horizontal direction securing spring 12 interposed by pushing the upper face of the core 16 with pressure in a vertical direction. Moreover, the vertical direction securing metal bracket 11 also has a function as a suppressing member for preventing the core 16 from popping toward an upper side of the reactor case 15.

The horizontal direction securing spring 12 is placed so as to be inserted between one side wall of the reactor case 15 and the core 16 (the core around which the coil is wound) and secures the core 16 to the reactor case 15, by horizontally pushing, with pressure, the core 16 to another side wall of the reactor case 15. The upper end portion of the horizontal direction securing spring 12, as described above, is pushed, with pressure, by the vertical direction securing metal bracket 11 with the vertical direction securing rubber bush 14 interposed between the upper end portion of the horizontal direction securing spring 12 and the vertical direction securing rubber bush 14 so that the horizontal direction securing spring 12 is secured in the reactor case 15.

In the conventional core securing structure shown in FIG. 1(*a*) and FIG. 1(*b*), the member for securing the core is mainly made up of three members including the vertical direction securing metal bracket 11, vertical direction securing rubber bush 14, and horizontal direction securing spring 12, and vertical and horizontal securing of the core is carried out by respective members. As a result, a required component count only for the core securing member is 3 or more. Also, a plurality of members for securing a core is mounted in the reactor case 15 and, therefore, it is unavoidable that the structure of the reactor components becomes complicated.

Patent Reference 1: Japanese Patent Application No. 2005-72198

DISCLOSURE OF THE INVENTION

Problems to be Solved by the Invention

In the structure of the conventional core structure described above, the core is secured using a plurality of securing members which causes complication of the placement of members and securing method, thus resulting in lowering of space efficiency. As a result, the conventional reactor presents problems in that it is difficult to achieve miniaturization and lightweight of a reactor, increased costs, and the like. Also, a vertical movement (vibration) of the core is accommodated using a rubber bush, however, there is a fact that the rubber products are lack of reliability, which are unsatisfactory as the securing member. Conventionally, in electronic components such as reactors, waste is avoided as much as possible and costs are reduced, however, members for securing the core of the reactor are very important components from viewpoints of a vibration condition and a safeguard against physical shock and, therefore, the member for securing the core of the reactor is regarded as one of structure members for which reduction of costs is difficult.

An object of the present invention is to provide technology being capable of achieving miniaturization, lightweight, reduction of costs by simplifying a core securing structure of a reactor.

Means for Solving Problems

In the conventional core securing structure, the biaxial securing is achieved by combining the two uniaxial securing members. However, according to the present invention, by providing the spring member as the main securing member in a horizontal direction and by adding a pressing shape to the spring member, the biaxial securing is enabled using only one member.

That is, to achieve the above object, the core securing member of the present invention is so configured as to secure a core in a case in a reactor, in which the reactor includes at least the core, a coil in which a winding line is wound around the core, and the case houses the core and coil and wherein a first spring portion which gives momentum to a side of the core in the case in a horizontal direction and a second spring portion which gives momentum to an upper face of the core in a vertical direction are integrally formed.

By configuring the core securing member as above, unlike the conventional case where the two members are required to realize the biaxial securing, the biaxial securing can be achieved by using one member only and, therefore, it is possible to simplify the core securing structure of the reactor, thus enabling miniaturization, lightweight, and reduction of costs.

Also, in the core securing member of the present invention, a stopper portion is provided to restrict popping of the core from the case and the second spring portion may be integrally formed with a notch being interposed between the stopper and the second spring portion so that the stopper portion covers part of an upper face of the core.

By configuring the core securing member as above, not only the second spring portion simply gives momentum to the core for securing (pressing) but also the stopper formed integrally with the first and second springs can suppress the popping of the core from the case and, therefore, safety and reliability as the reactor can be enhanced without increasing the member.

Also, the core securing member of the present invention is configured so that the notch formed between the stopper and the second spring portion preferably has an R portion (round portion) and the R (curvature) on the stopper portion side is smaller than the R (curvature) on the second spring portion side.

By configuring the core securing member as above, the stopper portion and the second spring portion can be formed adjacently in a width direction so that part of the upper face of the core is covered and the portion in which the core securing member is secured to a case is placed so as to be tilted only by the stopper portion.

Moreover, to achieve the above object, the core securing member of the reactor described above is configured to be inserted to one end side in the case to be secured to the case and the core securing member gives momentum to the core in the case in horizontal and vertical directions.

By configuring the core securing member as above, the core securing structure of the reactor can be simplified effectively, which enables the miniaturization, lightweight, and reduction of costs.

Effects of the Invention

By applying the core securing spring structure for biaxial securing, the component count of the reactor of the present invention can be reduced, thereby achieving lightweight and reduction of costs. The miniaturization resulting from an increase in space efficiency can be realized. Also, the freedom of design from viewpoints of optimum design of the spring itself is significantly great and, therefore, the core can be secured at the most optimum securing position, thus enabling the miniaturization of the spring itself. The core securing member can be secured at one portion, which can provide an advantage of decreasing the number of man-hours for assembly.

BEST MODE OF CARRYING OUT THE INVENTION

Figure 1:
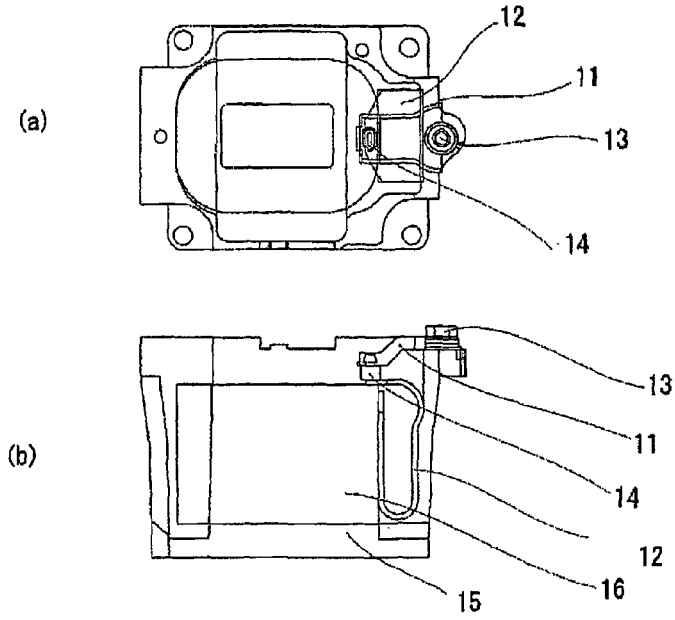
FIG. 1 is a diagram showing a conventional core securing structure and FIG. 1(*a*) is its plan view and FIG. 1(*b*) is its side view.
Figure 2:
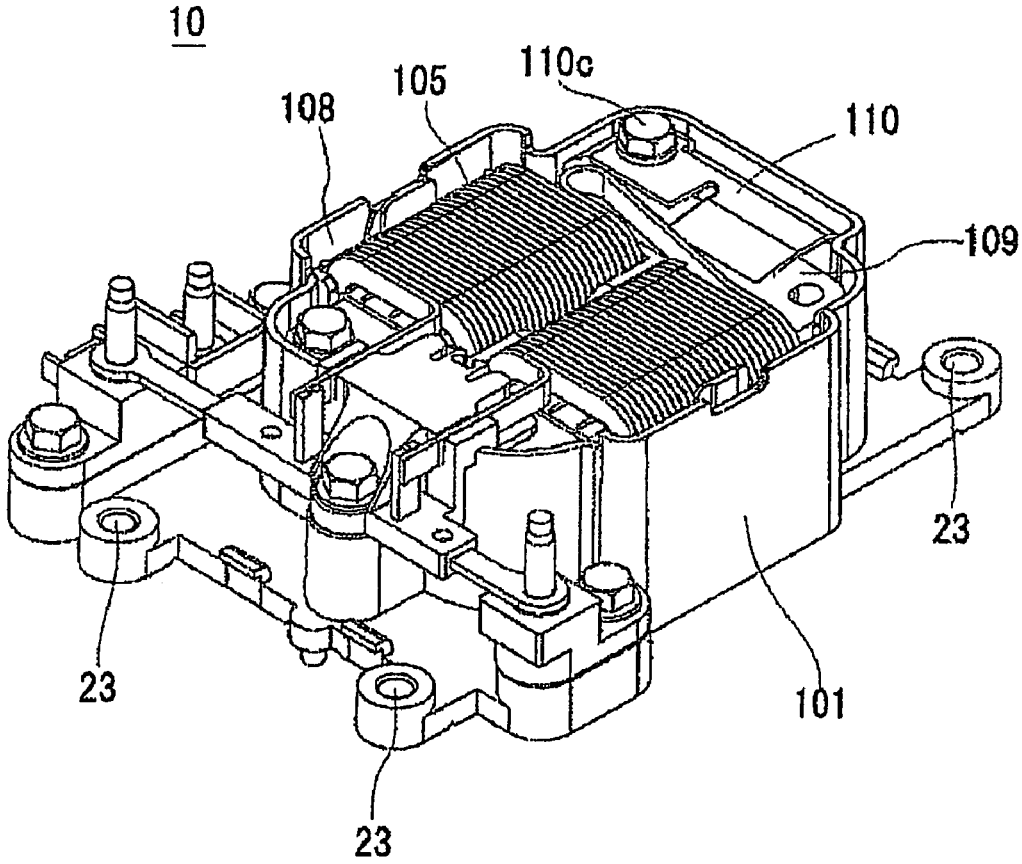
FIG. 2 is a perspective view showing a reactor as one of examples the core securing structure of an embodiment of the present invention.
Figure 3:
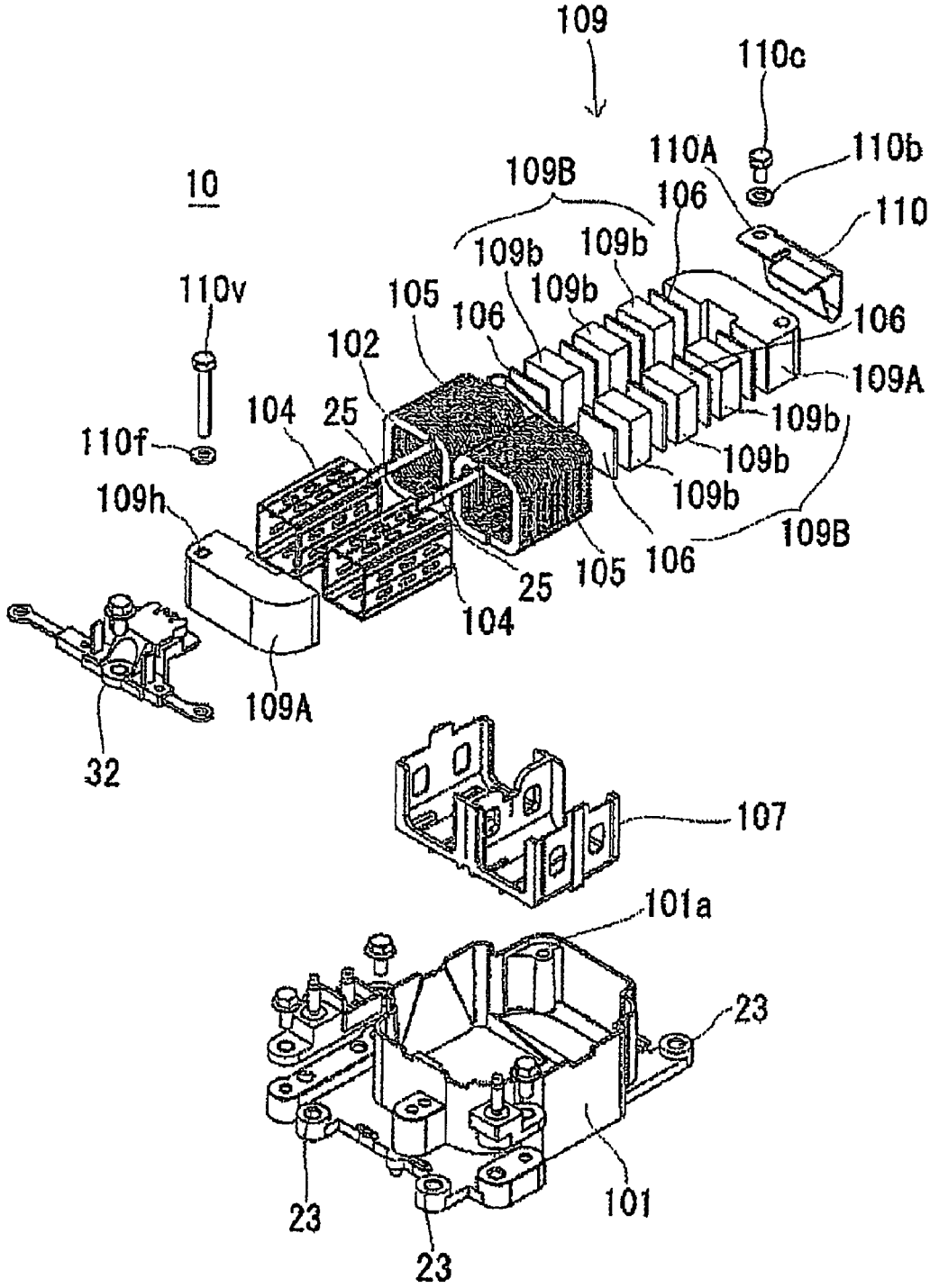
FIG. 3 is an exploded perspective view showing the reactor shown in FIG. 2.
Figure 4:
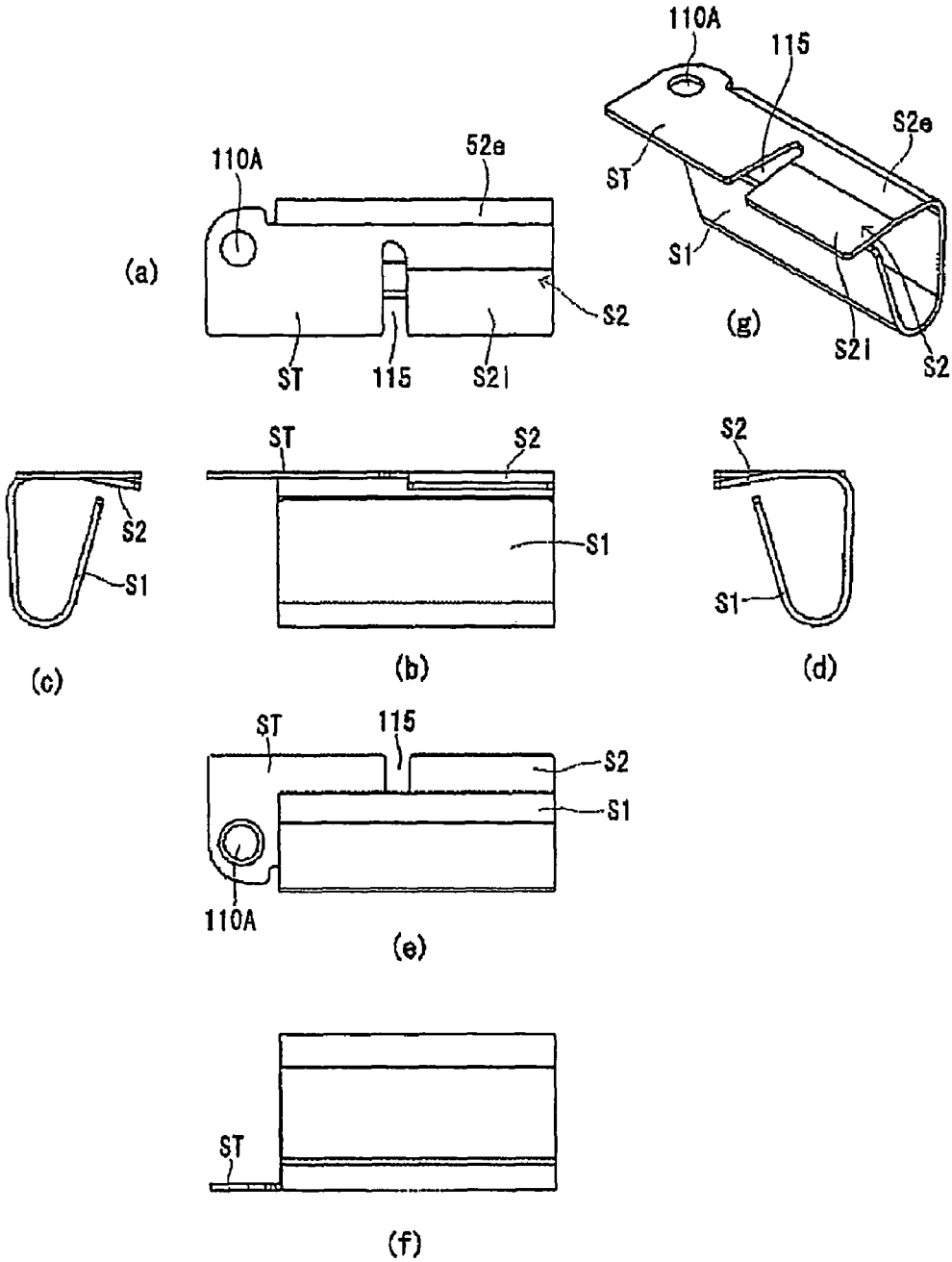
FIG. 4 is a diagram showing a core securing member according to an embodiment of the present invention and FIG. 4(*a*) is its plan view, FIG. 4(*b*) is its front view, FIG. 4(*c*) is its left side view, FIG. 4(*d*) is its right side view, FIG. 4(*e*) is its bottom view, FIG. 4(*f*) is its rear view and FIG. 4(*g*) is its perspective view.

A core securing member and its structure of an embodiment of the present invention are described in detail by referring to drawings. FIG. 2 is a perspective view of one example of a reactor including a core securing structure of the embodiment of the present invention. FIG. 3 is an exploded perspective view of the reactor shown in FIG. 2. FIG. 4 is a diagram showing a core securing member of the embodiment of the present invention and FIG. 4(*a*) is its a plan view, FIG. 4(*b*) is its front view, FIG. 4(*c*) is its left side view, FIG. 4(*d*) is its right side view, FIG. 4(*e*) is its bottom view, FIG. 4(*f*) is its rear view, and FIG. 4(*g*) is its perspective view.

The reactor 10 shown in FIGS. 2 and 3 is used in an electronic circuit having, for example, a forcedly cooling means and is so configured that reactor components formed by winding a winding line 102 around a core 109 (particularly, see FIG. 3) using a winding frame are housed into a thermal conductive reactor case 101 with an insulating member 107 interposed between the reactor components and the reactor case 101 and then a filler 108 is poured to achieve securing (sealing with resin) the components. A lead portion is so configured that a coating of its winding line 102 is peeled in a manner in which a conductor is stripped and is connected to other electronic components or the like, via a terminal unit 32. Moreover, a reactor securing hole 23 formed on each corner of the reactor case 101 is used as a screw hole to secure the reactor case 101 to, for example, a forcedly cooled cabinet or a like.

Also, the reactor 10 of the embodiment of the present invention has a core securing member 110 as a member having a securing structure which enables biaxial securing (giving momentum) in horizontal and vertical directions by using one member only. The core securing member 110, as shown in FIG. 3, is inserted between the reactor case 101 and the core 109 after the core 109 or the like has been housed into the reactor case 101 and is secured to the reactor case 101 by letting a bolt 110*c* pass through its bolt hole 110A with a washer 110*b* interposed between the bolt hole 110A and the bolt 110*c* and by letting the bolt 110*c* be screwed into a screwing hole 101*a* formed at a corner of the reactor case 101.

Moreover, the core 109 is made up of a core member 109B constituting a winding portion around which a winding line 102 is wound and a core member 109A constituting a non-winding portion around which the winding line 102 is not wound and the core member 109B is magnetically coupled to the core member 109A with a gap between the core member 109B and core member 109A. Also, as shown in FIG. 3, the core member 109B is so configured as to have two rows of magnetic blocks 109*b*, each row including 3 blocks 109*b* with a gap sandwiched among the magnetic blocks 109*b*. That is, the core member 109B is made up of 6 pieces of magnetic blocks 109*b* in total and, as the result, the core 109 is configured so as to be split in eight as a whole. Between each of the core members 109B and the core member 109A and among the magnetic blocks 109*b* making up the core member 109B is inserted a gap and, for example, a ceramic sheet 106 is placed in each gap.

As is apparent from FIG. 3, the reactor 10 is configured by assembling a plurality of components, besides the core securing member 110. Therefore, by applying the core securing member 110 of the embodiment that enables biaxial securing using one member only, an effect is enhanced that the component count can be reduced and the number of man-hours for assembly can be increased.

As shown in FIG. 4 (*a*) to FIG. 4 (*g*), the core securing member 110 is made up of the first spring portion S1 being warped (curled) from a rear side to a front side, the second portion S2 placed in an inclined state from an upper side to a bottom side, and a stopper portion S1 placed so as to cover an upper face of the core 109, with all of them being formed integrally.

The first spring portion S1 makes up the most sizable proportion of the core securing member 110 and is formed so as to have a shape warped (curled) over all its width from a left side face to a right side face. The core 109 vibrates due to magnetic forces of attraction described above in a horizontal direction and noises occur depending on magnitude of the vibration, which presents a problem in terms of performance capabilities and, therefore, it is necessary to reliably accommodate (dampen) the vibration in a horizontal direction. To do this, all portions of the core 109 over all its width from a rear portion to a front portion are formed as spring members.

The stopper portion ST has a shape in which approximately half of the core securing member 110 in its width direction from a left side portion to its central portion protrudes, like eaves, toward an upper face side of the core 109. The stopper portion ST serves also as the securing portion of the core securing member 110 and in a corner portion on its left rear side is formed the bolt hole 110A described above.

The second spring portion S2 is so formed that approximately half of the core securing member 110 in its width direction from a right side portion to its central portion covers part of an upper face of the core 109, as is the case of the stopper portion ST, with a notch 115 at a boundary between the stopper portion ST and the second spring portion S2 formed. The second spring portion S2 includes a flat portion S2*e* formed on the same face as the stopper ST and a tilted portion S2*i* bent toward a lower side with a slight slant. The tilted portion S2*i* is bent so as to be elastically deformed with a tilted angle at which an upper face of the core 109 is pushed, with pressure, thus giving momentum to the upper face of the core 109 in a vertical direction.

Here, in the notch 115 formed at a boundary between the stopper portion ST and second spring portion S2 of the core securing member 110 of the embodiment of the present invention, as is made clear from FIG. 4 (*a*), the R portion (round portion) on the side of the stopper portion (on the secured side, that is, on the side of bolt hole 110A) is small and the R portion (round portion) on the side of the second spring portion S2 (on the movable side) is large. This is for the reason that the left half of the core securing member 110 is used as the stopper portion ST and the right half of the core securing member 110 is used as the second spring portion S2 and, therefore, at the R portion (round portion) on the rear side of the notch 115, stress is easily concentrated on the spring portion S2 side serving as a movable portion and, to disperse the stress, the R portion (round portion) on the second spring portion S2 side (movable side) is formed so as to be larger. Owing to this formation of the R portion and to the securing at one point (one side only) by using the bolt 110C (see FIGS. 2 and 3), the core securing member 110 is well balanced.

The second spring portion S2 has to hold the core 109 by giving momentum to the upper face in a vertical direction, however, on the other hand, if the second spring portion S2 holds the core 109 too strongly (that is, reaction force is too intense), the core as a structural body is broken and, therefore, a limit of a load is set to a level on the verge of plastic deformation.

The core securing member 110 of the embodiment having configurations as above can be fabricated by performing pressing and bending processes using, for example, SUS (Stainless Use Steel) as a material for the material. That is, after the material is die-cut using a development diagram, by performing three-time bending process, the core securing member 110 can be fabricated easily.

Figure 5:
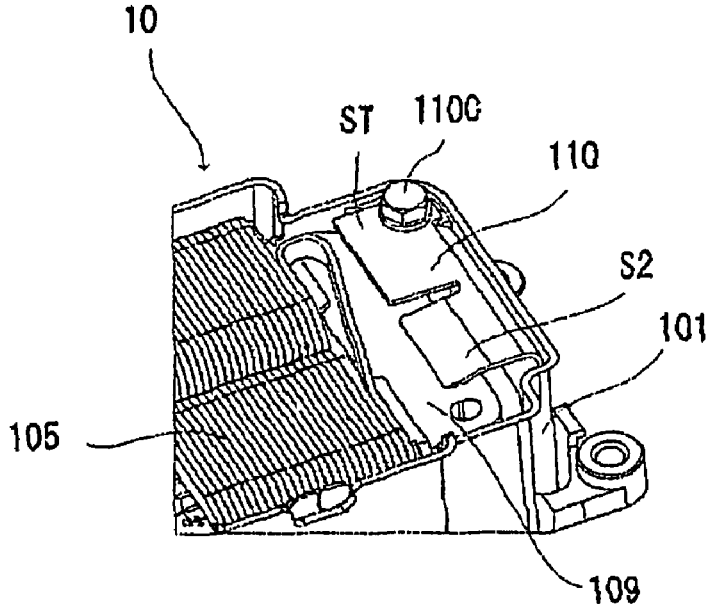
FIG. 5 is the first perspective view showing the core securing member of the embodiment of the present invention.

FIG. 5 is the first perspective view showing configurations for core securing of the embodiment of the present invention.

Figure 6:
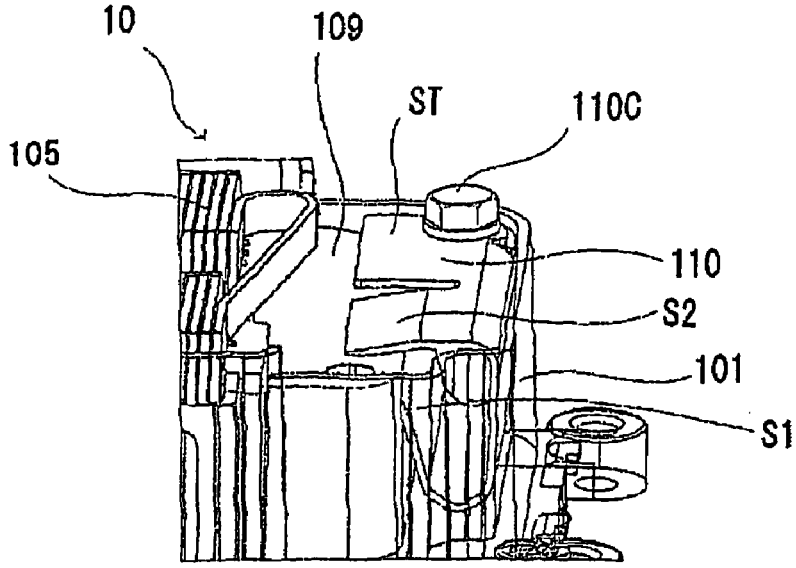
FIG. 6 is the second perspective view showing the core securing member of the embodiment of the present invention.

FIG. 6 is the second perspective view showing configurations for core securing of the embodiment of the present invention.

According to the configurations for securing the core 109 applied to the reactor 10 of the embodiment of the present invention, as shown in FIGS. 5 and 6, by inserting the single core securing member 110 in which the first spring portion S1 and second spring portion S2 are integrally formed into one end side in the reactor case 101 and by securing the core securing member 110 to the reactor case 101 using the bolt 110C, the core 109 can be held (secured) only by the single core securing portion 110 which gives momentum to the core 109 in the reactor case 101 in horizontal and vertical directions.

Here, the second spring portion S2 accommodates vibration (for example, up to 20 G) ordinarily occurring in the core 109 of the reactor 10, while the stopper portion ST accommodates vibration (for example, exceeding 20 G) occurring in a vehicle-mounted reactor 10 in an emergency such as a collision of a vehicle (to prevent popping). The function of accommodating the vibration serves as a fail safe to prevent ignition caused by a short circuit among surrounding wirings when the core 109 (and coil 105) pops from the reactor case 101 in an emergency such as the collision of a vehicle. According to the embodiment of the present invention, as described above, after the core 109 (and the coil 105) is housed in the reactor case 101, a filler is poured to seal with resin, however, high safety can be ensured by the stopper portion ST without being reliant on the resin.

As described above, in the reactor 10 of the embodiment of the present invention, the securing of the core 109 in a horizontal direction is performed by using the first spring portion S1 of the core securing member 110 and, by pressing the core 109, with pressure, to an inside face of the reactor case 101, the core 109 can be held in horizontal and vertical directions. Also, the core securing member 110 is so configured that the first spring portion S1 constituting one side of the core securing portion S1 serves as a free terminal, thereby enabling relief of the thermal stress caused by a change in temperatures (difference of linear expansion).

Moreover, by configuring the core securing member 110 so that the first spring portion S1 constituting its one side serves as the free terminal, the core securing member 110 is able to have a function of attenuating (damping) vibration caused by the magnetic forces of attraction of the core 109 in the reactor case 101. That is, the magnetic force of attraction acts between the core member 109A and 109B by a flux occurring when a current flows through the winding line 102, which causes the core 109 to vibrate in the reactor case 101 in a horizontal direction. By accommodating the vibration using the spring portion S1 constituting a free terminal of the core securing member 110, it is made possible to effectively damp the vibration of the core 109 and noises occurring from the vibration. In some cases, the coil 109 moves (rattles) in the reactor case 101 due to an impulse from the outside and, even in such a case, the core securing member 110 is able to have a function of attenuating (damping) the rattle of the core 109 in the reactor case 101.

On the other hand, the securing of the core 109 in a vertical direction can be achieved by making the second spring portion S2 push one end portion of the core 109 in a vertical direction and making another end portion of the core 109 be secured fully in a vertical direction using a bolt 110*v* (see FIG. 3). According to the embodiment of the present invention, as described above, one end portion of the core 109 is pushed by the second spring portion S2 in a vertical direction and another end portion of the core 109 is secured fully in the vertical direction using the bolt 110*v*, thus enabling the adhesion between the core 109 and a bottom of the reactor case 101 to be ensured. As the result, it is made possible to ensure a stable dissipation route via a bottom of the reactor case 101 from the coil 105 and core 109. That is, as shown in FIG. 3, a bolt hole 109*h* is formed in the core member 109A of the core 109 and by making the bolt 110*v* pass through the bolt hole 109*h* with a washer 110*f* interposed between the bolt 110 and bolt hole 109*h* and by making the bolt 110*v* be screwed into an illustrated screwing hole at a corner of a bottom of the reactor case 101, another end portion of the core 109 is secured in the reactor case 101.

Moreover, the stopper portion ST of the core securing member 110 has a function of preventing the popping of the core 109 (as a fail safe measure), for example, when the reactor 10 is suspended in an inverted state.

By applying the core securing member having the above configurations of the embodiment of the present invention, the following advantages can be obtained. That is, the spring accommodating the vibration in horizontal and vertical directions is integrally formed, thus enabling compact design of the core securing member.

Moreover, in the conventional example described above, a rubber bush is attached to the core securing member made of metal and vibration of the core in a vertical direction is damped using the rubber bush. However, according to the present invention, simply by using the metal spring member, vibration in a vertical direction can be damped, thereby providing good component efficiency.

Also, the spring member is integrally structured so as to damp the vibration in horizontal and vertical directions and, therefore, the vibration of the core can be damped more effectively when compared with the conventional example. There are some cases where vibration in horizontal and vertical directions occurs in a combined state. For example, there is a case where the core vibrates in a horizontal direction due to magnetic forces, while the core vibrates in a vertical direction due to an impact from the outside. In the conventional example, the vibration is accommodated by using two separate members and, as a result, the efficiency of accommodation of the vibration is more excellent in the embodiment of the present invention compared with the conventional example.

In the conventional example, the core securing member is made up of two main components and it is therefore necessary that the core securing member is secured to the reactor case at two points, however, according to the core securing member of the present invention, it is enough that the core securing member is secured to the reactor case only at one point and, as the result, time for attachment can be saved.

There is a variation in height of the core itself. However, in the case where a lower core is used, when the core securing member is attached, by pressing down the second spring portion S2 to a bottom face side to attach the second spring portion S2 at a bit large tilt angle, such a variation can be reduced.

Having described the invention as related to the embodiment, it is an intention that the invention be not limited by any of the details of description, unless otherwise specified, but rather be constructed broadly within its spirit and scope as set out in the accompanying claims.

For example, in the above embodiment, the core securing structure of the present invention is applied to a split-type core made up of a plurality of magnetic blocks, however, it is needless to say that the core securing structure can be applied to a non-split type core.

Also, in the above embodiment, the core securing member is secured to the reactor case at one point (on one side) using a bolt, however, both the side portions of the core securing member (on both sides in a width direction) may be secured to the reactor case by using bolts. In the above embodiment, the second spring portion S2 is formed on a half side (in a width direction) of the core securing member, however, the second spring portion S2 may be formed on a central portion. However, as in the case of the embodiment, by securing the core securing member to the reactor case at one point (on one side), space for the attachment (securing) can be saved and one bolt is enough to secure the core securing member, thus reducing costs.

Moreover, the second spring portion, as in the case of the first spring portion, may be configured as a curled spring (curled to a lower side).

INDUSTRIAL APPLICABILITY

The present invention can be applied widely to the core securing member and core securing structure so long as both the first spring portion that gives momentum to a side face of a core in a horizontal direction and the second spring portion that gives momentum to an upper face of the core are integrally formed irrespective of a shape of the spring portion and its remaining configurations or the like.

EXPLANATION OF LETTERS OR NUMERALS

10: Reactor, 109: Core, 104: Winding frame, 102: Winding line, 105: Coil, 107: Insulating member, 101: Reactor case, 108: Filler, 25: Lead line, 32: Terminal unit, 23: Reactor securing hole, 110: Core securing member, 110A: Bolt hole, 110*b*: Washer, 110*c*: Bolt, 101*a*: Screwing hole, 109A and 109B: Core member, 106: Sheet, 109*b*: Magnetic block, S1: First spring portion, S2: Second spring portion, 115: Notch, ST: Stopper portion, S2*e*: Flat portion, S21: Tilted portion

The invention claimed is:

1. A core securing member for securing a core in a case in a reactor, the reactor including at least the core, a coil in which a winding line is wound around the core, and the case housing the core and coil, the core securing member comprising:

a first spring portion which gives momentum to a side of the core in the case in a horizontal direction;

a second spring portion which gives momentum to an upper face of the core in a vertical direction, the second spring portion being in contact and integrally formed with the first spring portion; and a stopper portion to restrict popping of the core from the case, the stopper portion and the second spring portion being integrally formed with a notch being interposed between the stopper portion and the second spring portion such that the stopper portion covers a portion of the upper face of the core.

2. The core securing member according to claim 1, wherein the notch formed between the stopper portion and the second spring portion comprises an R portion (round portion), and wherein an R (curvature) of the R portion on a side of the stopper portion is less than an R (curvature) of the R portion on a side of the second spring portion.

3. The core securing member according to claim 1, wherein the core securing member is inserted to an end side in the case to be secured to the case, and wherein the core securing member gives momentum to the core in the case in horizontal and vertical directions.

4. The core securing member according to claim 2, wherein the core securing member is inserted to an end side in the case to be secured to the case, and wherein the core securing member gives momentum to the core in the case in horizontal and vertical directions.

5. The core securing member according to claim 1, wherein the first spring portion is directly connected to the second spring portion.

6. The core securing member according to claim 1, wherein a free end of the first spring portion faces a surface of the second spring portion.

7. The core securing member according to claim 1, wherein the first spring portion is curved such that a part of the first spring portion is coplanar with a free end of the first spring portion.

8. The core securing member according to claim 1, wherein the first spring portion comprises inner surfaces which face each other.

9. The core securing member according to claim 1, wherein a portion of a loop is formed by the first spring portion.

10. The core securing member according to claim 1, wherein the first and second spring portions comprise inner surfaces forming an open loop.

11. The core securing member according to claim 1, wherein an outer surface of the first spring portion contacts the side of the core.

12. The core securing member according to claim 1, wherein the stopper portion and the second spring portion are formed adjacently in a width direction.

13. The core securing member according to claim 1, wherein the second spring portion comprises:

a flat portion being in contact with the first spring portion; and a tilted portion being plastically deformable, angled from the flat portion, and in contact with the flat portion, and wherein an end of said tilted portion is in contact with the upper face of the core.

14. The core securing member according to claim 1, wherein the second spring portion comprises an aperture, a fastening member fastening the second spring portion to the case through the aperture.

15. The core securing member according to claim 1, wherein the stopper portion comprises an aperture through which a fastening member fastens the second spring portion to the case.

16. A core securing member for securing a core in a reactor case, the core securing member being secured to the reactor case by a fastening means and disposed between a first side of the reactor case and a first side of the core, the core securing member comprising:

a first spring portion comprising a first side portion and a second side portion connected by a first curved portion, the first spring portion securing the core horizontally against a second side of the reactor case, the first side portion being in contact with the first side of the core, the second side portion being in contact with the first side of the reactor case, the second side of the reactor case being in contact with a second side of the core;

a second spring portion connected to said second side portion by a second curved portion, said second spring portion securing the core vertically against a third side of the reactor case, the third side of the reactor case being in contact with a third side of the core, the second spring portion being in contact with a fourth side of the core; and a stopper portion to restrict popping of the core from the case, the stopper portion and the second spring portion being integrally formed with an aperture being interposed between the stopper portion and the second spring portion such that the stopper portion is disposed over the fourth side of the core, wherein said first spring portion is in contact and integrally formed with said second spring portion.

17. The core securing member according to claim 16, wherein said stopper portion is integrally formed with said first spring portion and said second spring portion, wherein said stopper portion is connected to said second side portion by said second curved portion, wherein said stopper portion and said second spring portion is partially separated by said aperture interposed between said stopper portion and second spring portion, and wherein said stopper portion is secured to said reactor case by said fastening means.

18. The core securing member according to claim 16, wherein said second spring portion comprises:

a flat portion connected to said stopper portion and said second curved portion, said flat portion partially separated from said stopper portion by said aperture, said flat portion being disposed over the fourth side of the core; and an angled portion being plastically deformable and connected to said flat portion, and wherein an end of said angled portion is in contact with the fourth side of the core and is completely separated from said stopper portion by said aperture.

19. The core securing member according to claim 1, wherein the stopper portion is integrally formed with the first spring portion.

20. The core securing member according to claim 1, wherein the second spring portion comprises a flat portion that is in contact with the first spring portion, said flat portion being formed on a same face of the second spring portion as the stopper portion.

* * * * *